US008459860B2

(12) United States Patent
Saito

(10) Patent No.: US 8,459,860 B2
(45) Date of Patent: Jun. 11, 2013

(54) LIGHT FLUX CONTROLLING MEMBER, LIGHT-EMITTING DEVICE AND LIGHTING DEVICE

(75) Inventor: Tomohiro Saito, Saitama (JP)

(73) Assignee: Enplas Corporation, Saitama (JP)

( * ) Notice: Subject to any disclaimer, the term of this patent is extended or adjusted under 35 U.S.C. 154(b) by 223 days.

(21) Appl. No.: 13/109,776

(22) Filed: May 17, 2011

(65) Prior Publication Data

US 2011/0286221 A1 Nov. 24, 2011

(30) Foreign Application Priority Data

May 18, 2010 (JP) ..... 2010-114721
Oct. 4, 2010 (JP) ..... 2010-224776

(51) Int. Cl.
*F21V 5/02* (2006.01)

(52) U.S. Cl.
USPC ..... 362/621; 362/608; 362/612; 362/339

(58) Field of Classification Search
USPC ..... 362/608–610, 612, 621, 622, 311.02, 362/332, 336, 337, 339
See application file for complete search history.

(56) References Cited

U.S. PATENT DOCUMENTS 7,524,098 B2 * 4/2009 Vennetier et al. ..... 362/555
8,360,593 B2 * 1/2013 Kim et al. ..... 362/97.3

FOREIGN PATENT DOCUMENTS

JP 2002-040261 A 2/2002
JP 2008-141152 A 6/2008

* cited by examiner

*Primary Examiner* — Thomas Sember
(74) *Attorney, Agent, or Firm* — Washida & Associates

(57) ABSTRACT

A light flux controlling member capable of uniformly illuminating an illumination-target surface arranged approximately in parallel with an optical axis of a light-emitting device and reducing the weight of an lighting device is provided. An light flux controlling member is arranged on an edge side of an illumination-target member together with a light-emitting device (10) to emit light from the light-emitting device (10) from an output surface (14) after causing the light to enter from an input surface (15). The input surface (14) includes a first input surface (18) arranged to be positioned on an optical axis L1 of the light-emitting device (10) approximately parallel to the illumination-target surface and a second input surface (20) positioned to enclose the first input surface (18). The input surface (14) and the output surface (15) are formed in such a way that the light emitted from the output surface (15) via the first input surface (18) with the maximum angle from the optical axis L1 has a larger angle from the optical axis L1 than the light emitted from the output surface (15) via the second input surface (20) with the maximum angle from the optical axis L1.

6 Claims, 14 Drawing Sheets

FIG.5A
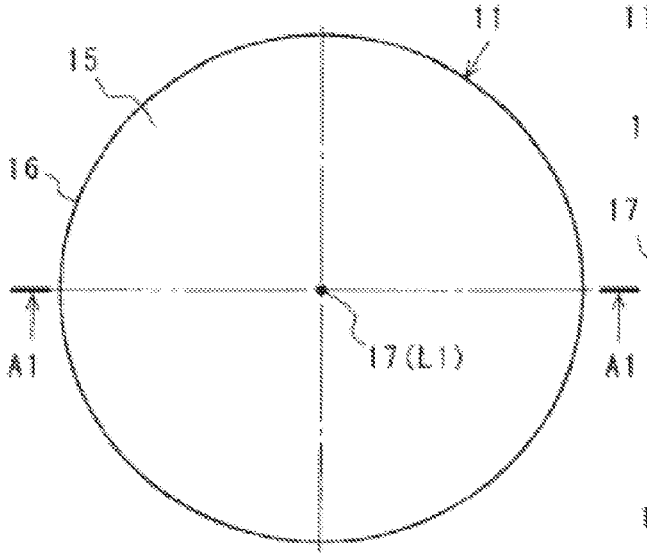
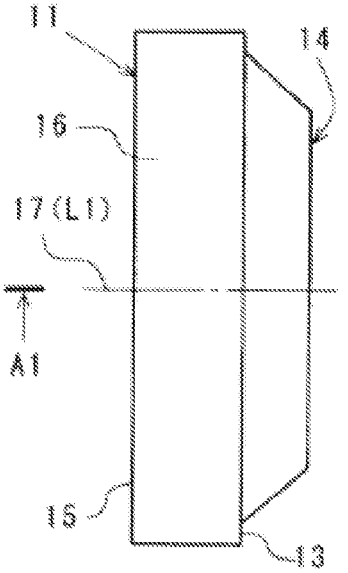
FIG.5D
FIG.5B
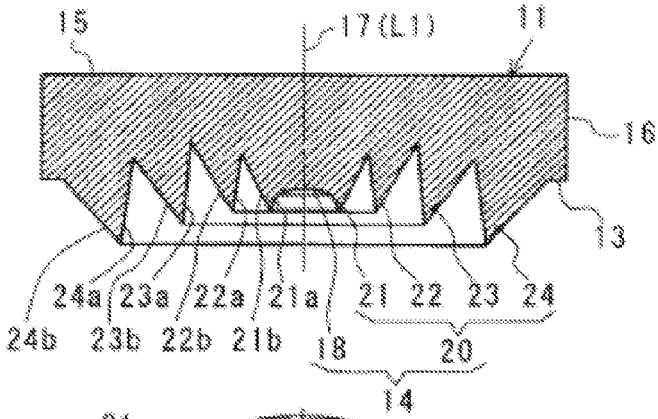
FIG.5C
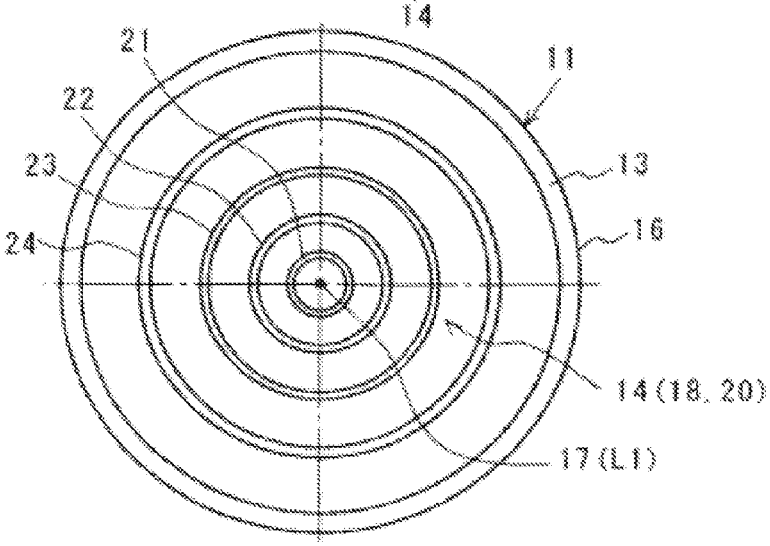

FIG.13A
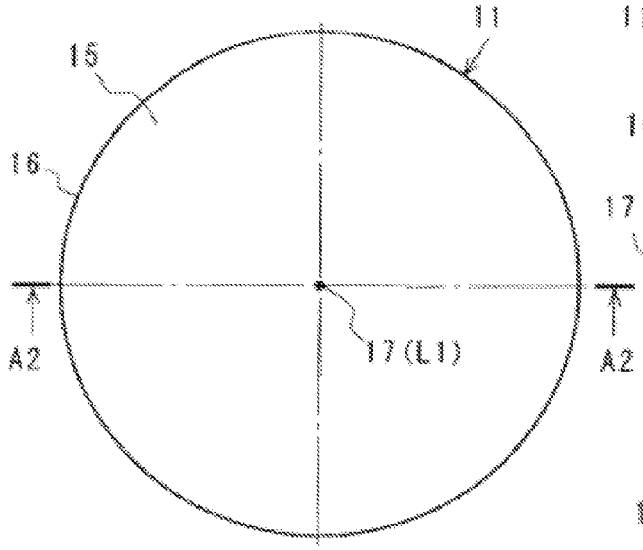
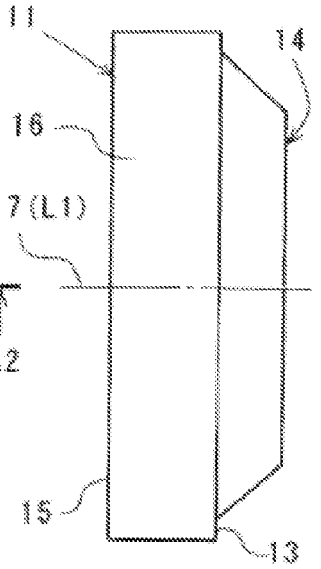
FIG.13D
FIG.13B
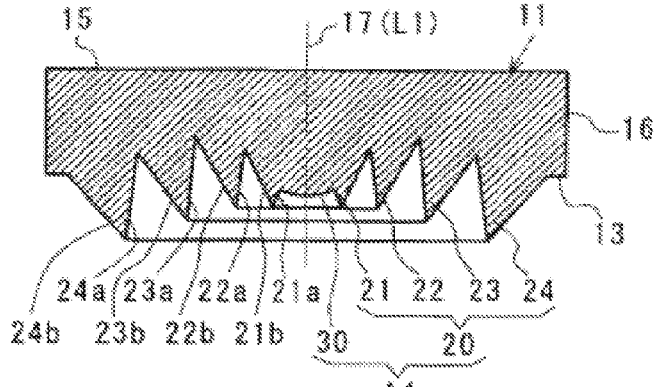
FIG.13C
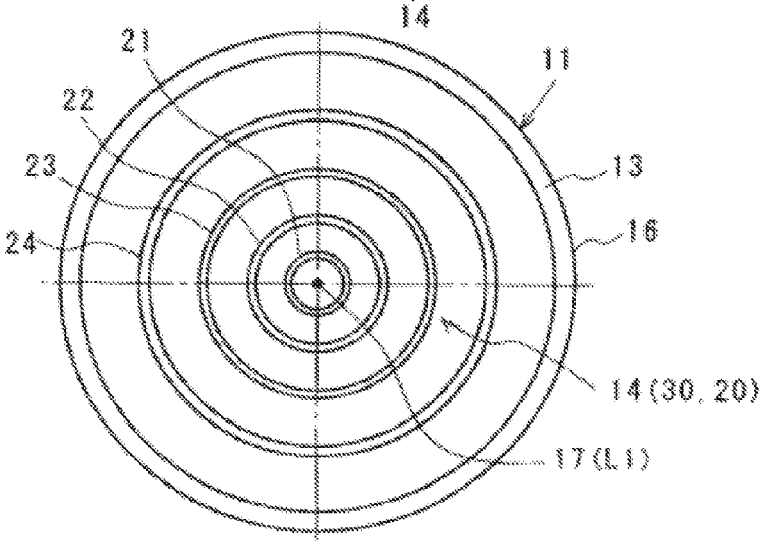

LIGHT FLUX CONTROLLING MEMBER, LIGHT-EMITTING DEVICE AND LIGHTING DEVICE

CROSS REFERENCE TO RELATED APPLICATIONS

The disclosures of Japanese Patent Applications No. 2010-114721, filed on May 18, 2010 and No. 2010-224776, filed on Oct. 4, 2010 including the specifications, drawings and abstracts are incorporated herein by reference in their entirety.

TECHNICAL FIELD

The present invention relates to a light flux controlling member that controls the direction of light emitted from a light-emitting device (for example, an LED), a light-emitting device including the light flux controlling member, and an lighting device that illuminates an illumination-target surface (for example, an advertising panel) of an illumination-target member by the light-emitting device from the back surface side.

BACKGROUND ART

Some types of lighting devices illuminate an illumination-target member having light transmission such as an advertising panel from the back surface side. In recent years, a light-emitting device (for example, an LED) whose power consumption is less than that of a fluorescent lamp and which has a longer life is used as a light source of such lighting devices.

CONVENTIONAL EXAMPLE 1

FIG. 1 is a diagram showing conventional lighting device 101 using light-emitting device 102 as a light source. Lighting device 101 has light-emitting device 102 arranged on an inner surface of top board 105 of case 104 in which a pair of illumination-target members 103, 103 is arranged opposite to each other. Lighting device 101 illuminates illumination-target surfaces 103*a*, 103*a* of illumination-target members 103, 103 with light emitted from light-emitting device 102 from inside.

However, in lighting device 101 shown in FIG. 1, though portions of illumination-target members 103, 103 near light-emitting device 102 are illuminated brightly, portions thereof at a distant from light-emitting device 102 are dark and a specific bright section is generated in a limited region (region near light-emitting device 102) of illumination-target members 103, 103 (see illuminance indication line D in FIG. 7). Thus, lighting device 101 cannot illuminate illumination-target surfaces 103*a*, 103*a* of illumination-target members 103, 103 uniformly

CONVENTIONAL EXAMPLE 2

FIG. 2 is a diagram showing conventional lighting device 111 that solves problems of lighting device 101 shown in FIG. 1. Lighting device 111 shown in FIG. 2 has a pair of light guide plates 114 arranged inside case 103 in which a pair of illumination-target members 112 is arranged opposite to each other. In lighting device 111, light emitted from light-emitting devices 115 arranged on side faces of each of light guide plates 114 is caused to enter light guide plate 114 and the light that has entered light guide plate 114 is caused to emit from an output surface of light guide plate 114, which is opposite to illumination-target member 112, in a surface shape. Accordingly, lighting device 111 can illuminate illumination-target members 112 uniformly from the back surface side (see Patent Literature 1)

However, to uniformly illuminate all surfaces of illumination-target members 112, lighting device 111 needs to use light guide plates 114 having almost the same area as those of illumination-target members 112, posing a problem of the too heavy total weight

CONVENTIONAL EXAMPLE 3

To reduce the weight of lighting device 111, conventional technology to use, instead of light guide plate 114, lens (light flux controlling member) 120 as shown in FIG. 3 is known. According to the conventional technology, lens 120 is arranged as if to cover light-emitting device 121 and light emitted from light-emitting device 121 is caused to emit from lens 120 so that illumination-target members are illuminated with the emission light (see Patent Literature 2).

Citation List

Patent Literature

PTL 1
Japanese Patent Application Laid-Open No. 2002-40261
PTL 2
Japanese Patent Application Laid-Open No. 2008-141152

SUMMARY OF INVENTION

Technical Problem

However, lens 120 shown in FIG. 3 is used to emit light emitted from light-emitting device 121 in parallel to optical axis L1 and thus, illumination-target members 103, 103 arranged almost in parallel with optical axis L1 cannot be illuminated uniformly.

An object of the present invention is to provide a light flux controlling member capable of uniformly illuminating an illumination-target surface arranged almost in parallel with the optical axis of a light-emitting device and reducing the weight of an lighting device, a light-emitting device including the light flux controlling member, and an lighting device including the light-emitting device.

Solution to Problem

A light flux controlling member according to the present invention is arranged on an edge side of illumination-target members together with a light-emitting device, emits light emitted from the light-emitting device from an output surface after causing the light to enter from an input surface, and illuminates illumination-target surfaces of the illumination-target members with the light emitted from the output surface, wherein the input surface includes a first input surface arranged so that the first input surface is positioned on an optical axis of the light-emitting device, which is approximately parallel to the illumination-target surfaces, and positioned opposite to the light-emitting device in a one-to-one correspondence and a second input surface positioned as if to enclose the first input surface, the first input surface is formed in such a way that the light in a center section of a light flux of the light flux emitted from the light-emitting device is caused to enter the output surface, the second input surface is composed of a group of a plurality of ring-shaped prism projections formed concentrically around the optical axis as if to enclose the first input surface and is formed so that the light other than the light in the center section of the light flux is caused to enter, the prism projection includes a first inclined surface that causes the light other than the light in the center section of the light flux to enter and a second inclined surface that totally reflects the light entered from the first inclined surface toward the output surface, and the input surface and the output surface are formed in such a way that the light emitted from the output surface via the first input surface with a maximum angle from the optical axis has a larger angle from the optical axis than the light emitted from the output surface via the second input surface with the maximum angle from the optical axis.

Advantageous Effects of Invention

According to the present invention, compared with a case when an illumination-target member arranged almost in parallel with the optical axis of a light-emitting device is illuminated with only the light-emitting device, the illumination-target member can uniformly be illuminated without generating a specific bright section on the illumination-target member near the light-emitting device. Moreover, an lighting device using a light flux controlling member according to the present invention has the light flux controlling member arranged on an edge side of an illumination-target member together with a light-emitting device and thus, compared with an lighting device using a light guide plate having almost the same emission area as that of the illumination-target surface of the illumination-target member, the total weight of the lighting device can be reduced.

BRIEF DESCRIPTION OF DRAWINGS

FIG. 5 is a diagram showing a light flux controlling member according to Embodiment 1 of the present invention;

FIG. 13 is a diagram showing the light flux controlling member according to Embodiment 3 of the present invention.

DESCRIPTION OF EMBODIMENTS

The embodiments of the present invention will be described in detail below with reference to the drawings (The Light-Emitting Device and Lighting Device)

Figures 4A, 4B:
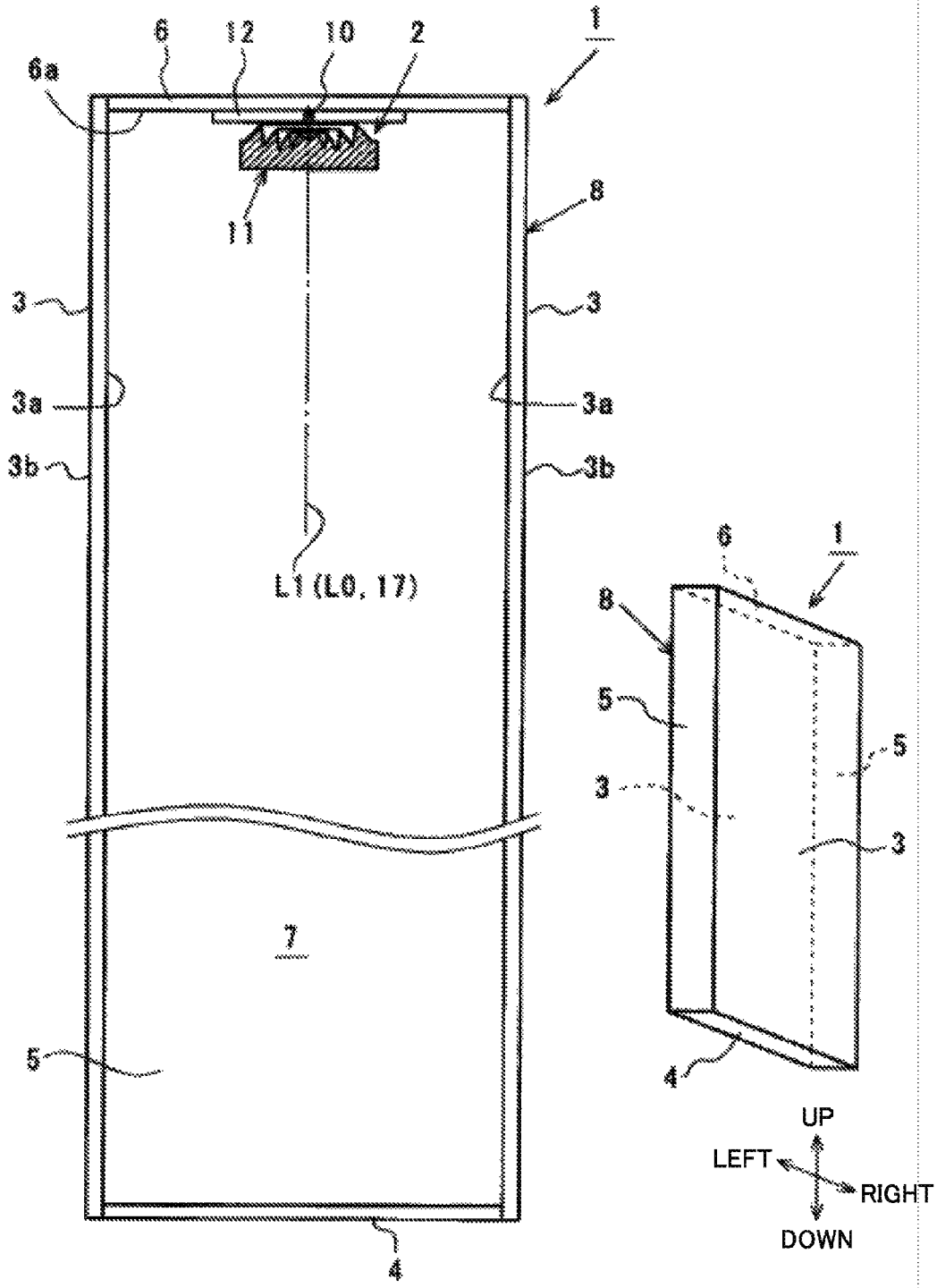
FIG. 4 is a diagram showing the lighting device according to an embodiment of the present invention and a light-emitting device constituting the lighting device.

FIG. 4 is a diagram showing lighting device 1 according to an embodiment of the present invention and light-emitting device 2 constituting lighting device 1. FIG. 4A of FIG. 4 is a schematic cross sectional view of lighting device 1 including reference optical axis L0 of light-emitting device 2. FIG. 4B is an external perspective view when lighting device 1 is viewed from obliquely below. Reference optical axis L0 is a traveling direction of light in the center of a three-dimensional emitting light flux from light-emitting device 2

As shown in FIG. 4, lighting device 1 has a pair of flat illumination-target members 3 (for example, advertising panels) having light transmission arranged opposite to each other. The lower edge of each of illumination-target members 3, 3 is closed by bottom plate 4. A space between left edges of illumination-target members 3, 3 and a space between right edges thereof are closed respectively by side plates 5, 5. The top edge of illumination-target members 3, 3 is closed by top plate 6. Accordingly, case 8 having internal space 7 is constituted Lighting device 1 also has light-emitting device 2 mounted on underside (surface on the inner side of case 8) 6*a* of top plate 6 constituting case 8. Lighting device 1 illuminates illumination-target surfaces (inner surfaces) 3*a*, 3*a* of the pair of illumination-target members 3, 3 using light-emitting device 2 from the back surface side (space 7 side) and the top edge side. In lighting device 1 shown in FIG. 4, the pair of illumination-target members 3, 3 is fixed to top plate 6 and bottom plate 4 so that the distance between the pair of illumination-target members 3, 3 is constant from the top edge side to the lower edge side. Incidentally, in accordance with emission light characteristics of light-emitting device 2, the pair of illumination-target members 3, 3 may be arranged so that the distance on the top edge side (top plate 6 side) is larger than that on the lower edge side (bottom plate 4 side) or the distance of the lower edge side (bottom plate 4 side) is larger than that on the top edge side (top plate 6 side). That is, the pair of illumination-target members 3, 3 may be postured so that illumination-target surfaces 3*a*, 3*a* thereof are illuminated by light-emitting device 2 and is arranged in symmetrical positions or asymmetrical positions with respect to optical axis L1 as an axis in a cross section including optical axis L1 of light-emitting device 10. Light-emitting device 2 is mounted on bottom plate 4 so that reference optical axis L0 is positioned approximately in parallel to illumination-target surface 3*a*. "Approximately parallel" takes an assembling error of light-emitting device 2 and case 8 or the posture of the pair of illumination-target members 3, 3 into account Light-emitting device 2 emits light emitted from light-emitting device 10 (for example, an LED or an LED sealed by a seal member) via light flux controlling member 11. There is a one-to-one correspondence between light-emitting device 10 and light flux controlling member 11. Light-emitting device 10 is fixed to top plate 6 of case 8 via board 12. Light flux controlling member 11 is fixed to board 12 via a holder (not shown) or the like. In the present embodiment, a case when optical axis L1 (traveling direction of light in the center of a three-dimensional emitting light flux from light-emitting device 10) of light-emitting device 10 and reference optical axis L0 match is taken as an example. Therefore, reference optical axis L0 is replaced by optical axis L1 in the description below (Embodiment 1 of the Light Flux Controlling Member)

Figure 6:
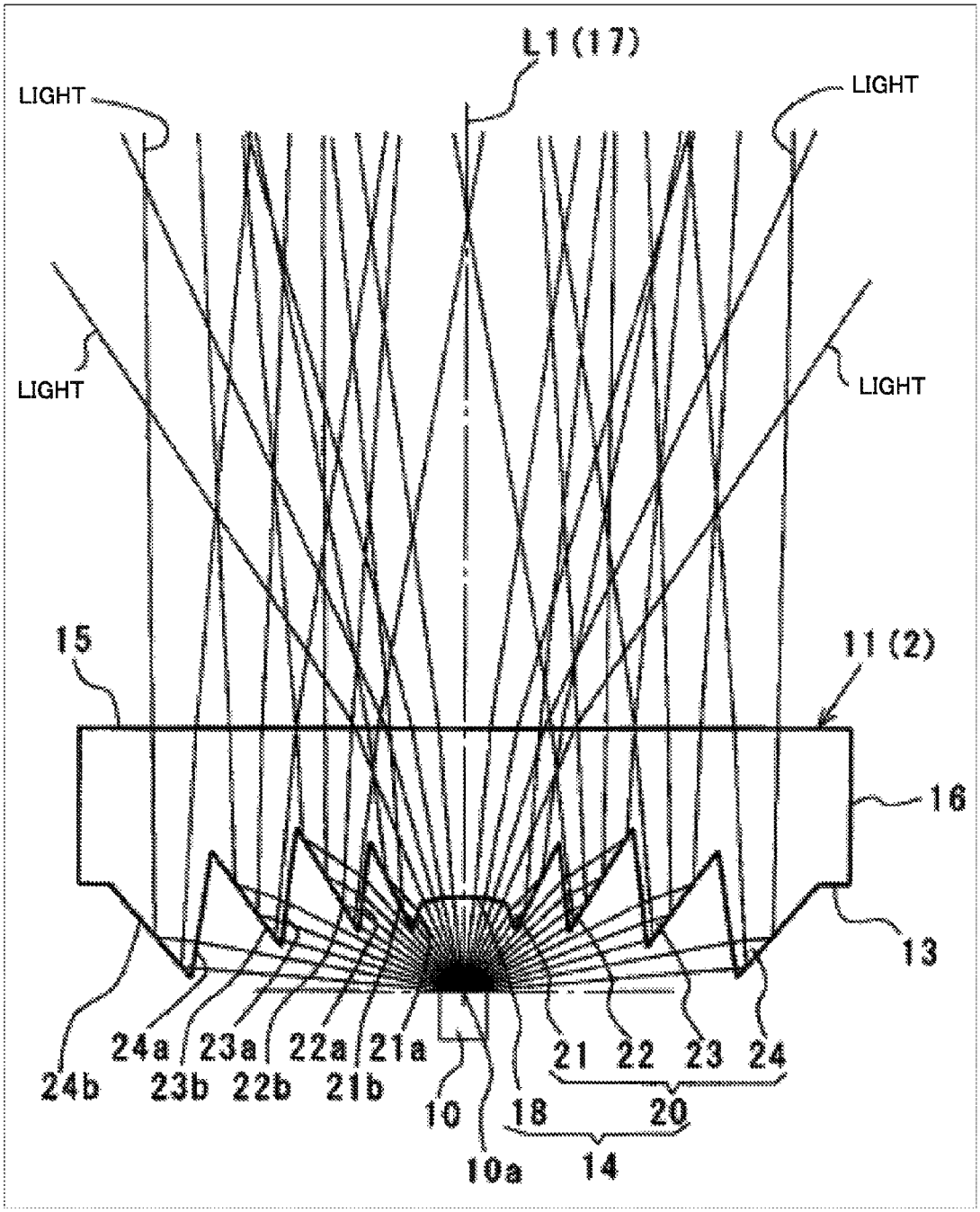
FIG. 6 is a diagram illustrating a function of the light flux controlling member according to Embodiment 1 of the present invention.

FIG. 5 is a diagram showing light flux controlling member 11 according to Embodiment 1 of the present invention. FIG. 6 is a diagram illustrating the function of light flux controlling member 11 according to Embodiment 1 of the present invention, FIG. 5A is a plan view of light flux controlling member 11, FIG. 5B is a cross sectional view of light flux controlling member 11 showing by cutting along the A1-A1 line in FIG. 5A, FIG. 5C is a rear view of light flux controlling member 11, and FIG. 5D is a side view of light flux controlling member 11. FIG. 6 is a diagram illustrating the function of light flux controlling member 11 and is a diagram illustrating by taking an example of an emitting light flux from emission center 10*a* of light-emitting device 10

Light flux controlling member 11 is formed of transparent resin materials such as PMMA (poly-methyl methacrylate), PC (polycarbonate), and EP (epoxy resin) or transparent glass. Light flux controlling member 11 has a cap shape used as if to cover light-emitting device 10 (see FIGS. 4 and 6). Light flux controlling member 11 includes input surface 14 formed on the side of back surface 13, which is opposite to light-emitting device 10, output surface 15 formed opposite to the side of back surface 13, and cylindrical side face 16 connecting the side of back surface 13 and output surface 15. Light flux controlling member 11 is formed to have a rotationally symmetric shape with respect to center axis 17. Light flux controlling member 11 is mounted on board 12 so that center axis 17 and optical axis L1 of light-emitting device 10 match (see FIGS. 4 and 6). Therefore, center axis 17 of light flux controlling member 11 is replaced by optical axis L1 as required in the description below Input surface 14 of light flux controlling member 11 is composed of first input surface 18 formed on the side of back surface 13 of light flux controlling member 11 and second input surface 20 formed on the side of back surface 13 of light flux controlling member 11 as if to enclose first input surface 18

First input surface 18 is a concave rotationally symmetric around center axis 17 and is a surface of a spherical recess or an aspherical recess formed when a portion of a sphere is pressed. First input surface 18 causes light in the center (near optical axis L1) of a light flux emitted from emission center 10*a* of light-emitting device 10 to enter by refracting the light so as to travel directly to output surface 15 (see FIG. 6)

Second input surface 20 is composed of a group of a plurality of prism projections (21 to 24) formed concentrically around center axis 17 surrounding first input surface 18. Light other than light entering first input surface 18 of a light flux emitted from light-emitting device 10 is condensed to the side of optical axis L1 compared with a state before entering light flux controlling member 11. The group of prism projections (21 to 24) is composed of first to fourth prism projections 21 to 24 formed adjacent to each other from an inner side toward an outer side in the axial direction. First to fourth projection prisms 21 to 24 are formed, as shown in FIG. 5C, in a ring shape respectively. First to fourth prism projections 21 to 24 are respectively formed in a shape whose section is substantially triangular composed of two inclined surfaces (first inclined surfaces 21*a* to 24*a* and second inclined surfaces 21*b* to 24*b*) that converge as moving in the direction toward light-emitting device 10 (see FIGS. 5B and 6). First inclined surfaces 21*a* to 24*a* positioned on the inner side in the axial direction (center axis 17 side) cause light other than light entering first input surface 18 to enter light flux controlling member 11. Second inclined surfaces 21*b* to 24*b* positioned on the outer side in the axial direction totally reflect light entered from first inclined surfaces 21*a* to 24*a* to the side of output surface 15 (see FIG. 6)

Output surface 15 is a plane whose plane shape is circular (see FIG. 5A) and formed perpendicularly to center axis 17 (see FIGS. 5B and 5D). Input surface 14 and output surface 15 are formed in such a way that light emitted from output surface 15 via first input surface 18 with the maximum angle from optical axis L1 has a larger angle from optical axis L1 than light emitted from output surface 15 via second input surface 20 with the maximum angle from optical axis L1 (see FIG. 6). Output surface 15 is not limited to the plane shown in FIGS. 5B and 5D. As far as light that enters light flux controlling member 11 via first input surface 18 and second input surface 20 can be controlled and emitted as described above, a portion or all of output surface 15 may be a convex (spherical or aspherical) around center axis 17 or a concave (spherical or aspherical) around center axis 17. A prism height or a prism recess positioned between illumination-target members 3, 3 in a symmetric shape with respect to the plane including center axis 17 may be formed on output surface 15. Further, the plane shape of output surface 15 is not limited to circular and may be elliptic or rectangular Side face 16 is a cylindrical surface parallel to center axis 17. Side face 16 is not limited to the shape of FIG. 5B and may be a taper surface tilted with respect to center axis 17. Side face 16 may have a flange or projection to hook a holder (not shown) formed by protruding outward in the radial direction In the present embodiment, second input surface 20 is not limited to a concentric annular shape and may be formed in such a way that the ridge line is an elliptic shape in a plan First input surface 18 in light flux controlling member 11 in Embodiment 1 is formed in such a way that a light flux corresponding to 8/37 of emission light from light-emitting device 10 enters. It is preferable as a design value that ¼ of emission light from light-emitting device 10 or less enters first input surface 18 as a light flux. If more than ¼ of emission light from light-emitting device 10 enters first input surface 18, a bright section is more likely to be generated in a position of illumination-target members 3, 3 closer to light-emitting device 10

(Comparison of an Lighting Device in the Present Embodiment and an Lighting Device in Conventional Example 1)

Figure 1:
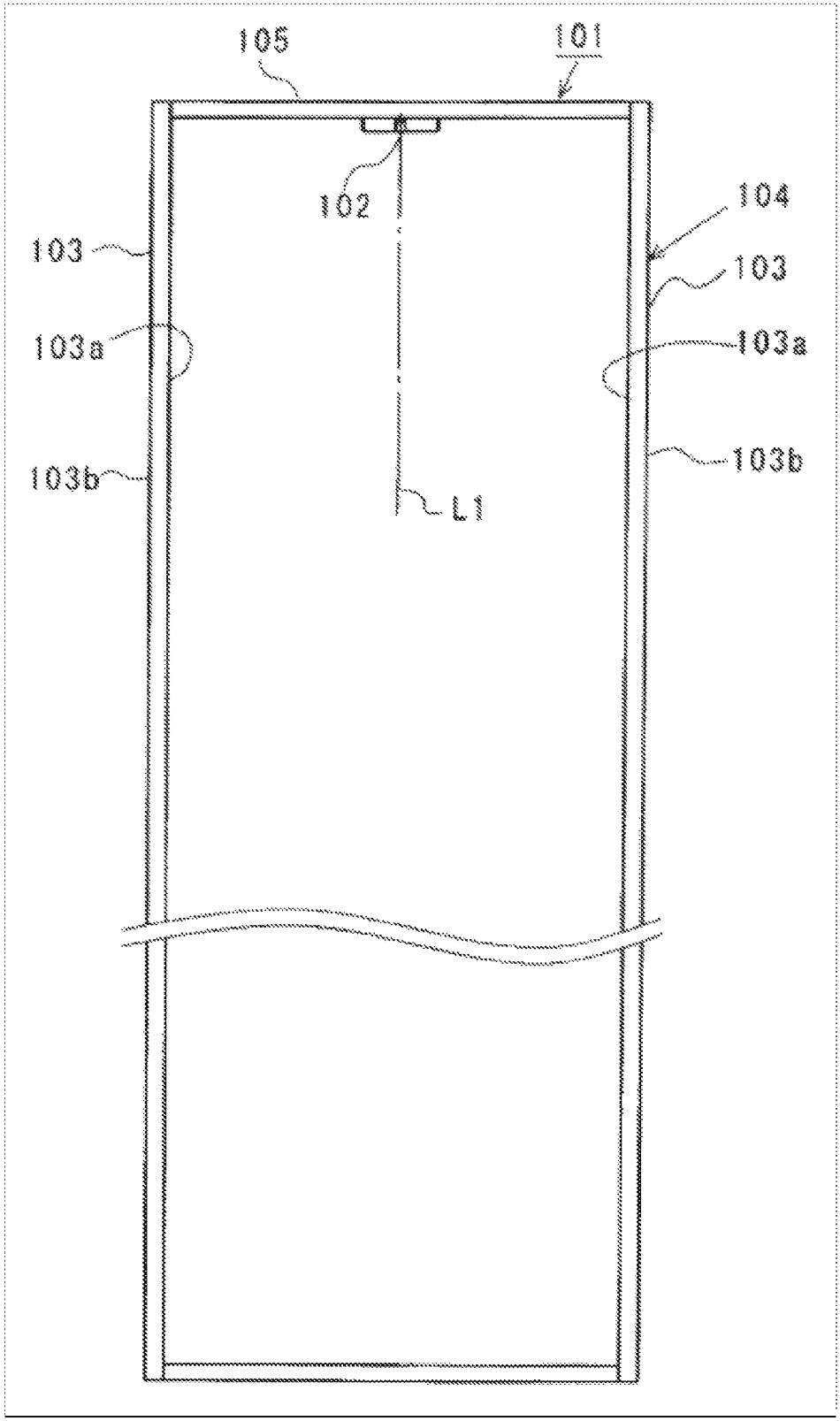
FIG. 1 is a cross sectional view of an lighting device according to Conventional Example 1.
Figure 2:
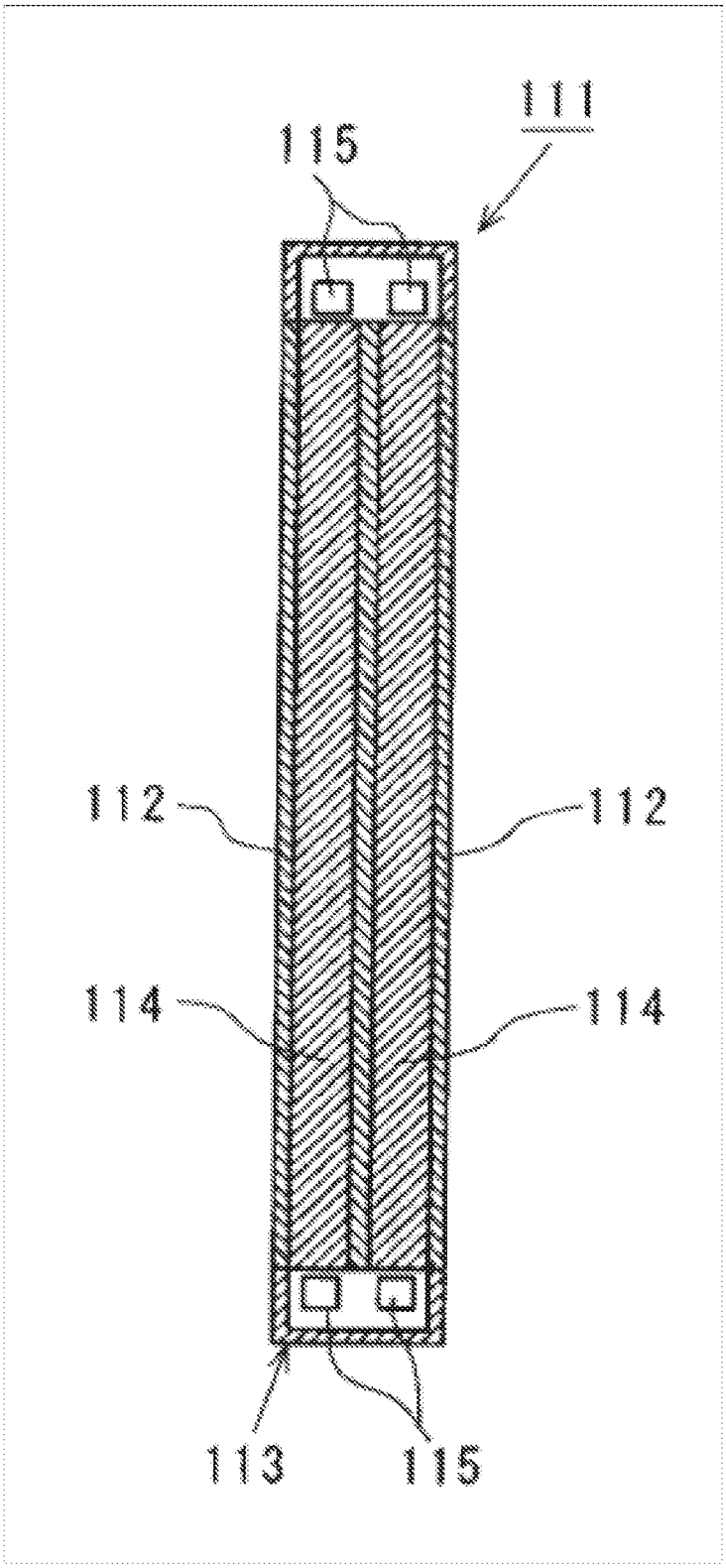
FIG. 2 is a cross sectional view of the lighting device according to Conventional Example 2.
Figure 3:
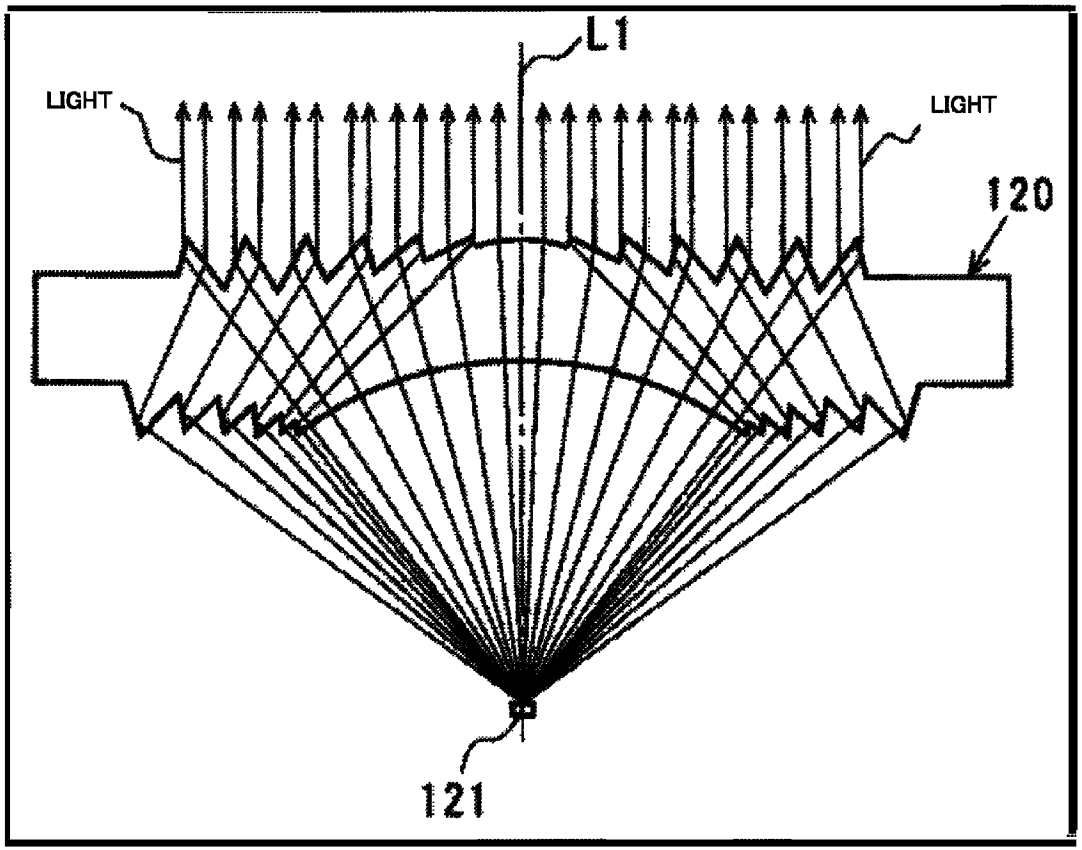
FIG. 3 is a cross sectional view of a lens according to Conventional Example 3.
Figure 7:
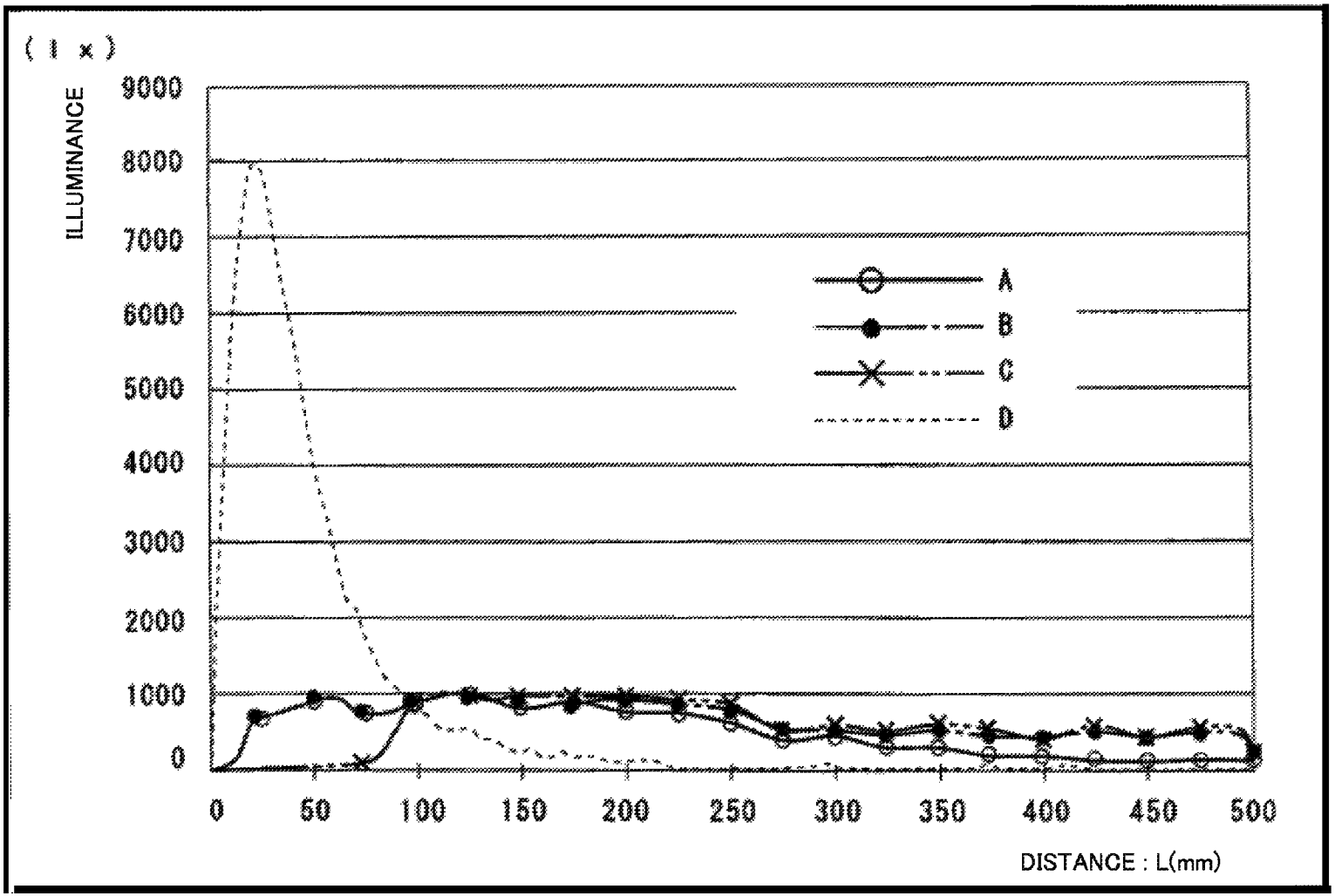
FIG. 7 is a diagram showing illuminations of illumination-target members in the lighting device according to the present invention and illuminations of illumination-target surfaces of illumination-target members in the lighting device according to Conventional Example 1 for comparison.

FIG. 7 is a diagram showing an illumination obtained by light that has passed through illumination-target surfaces 3*a*, 3*a* of illumination-target members 3, 3 in lighting device 1 in the present embodiment reaching external surfaces 3*b*, 3*b* (called an external surface illumination for convenience (see illuminance indication line A)) and an illumination obtained by light that has passed through illumination-target surfaces 103*a*, 103*a* of illumination-target members 103 in lighting device 101 in Conventional Example 1 (see FIG. 1) reaching external surfaces 103*b*, 103*b* (called an external surface illumination for convenience (see illuminance indication line D)) for comparison. FIG. 7 schematically shows a simulation experiment result by assuming that, excluding the difference of presence/absence of light flux controlling member 11, other sections (such as light-emitting devices 10, 102 and cases 8, 104) in both lighting devices 1, 101 are the same. In FIG. 7, the horizontal axis is the length (L (mm)) along optical axis L1 from one end to the other end of illumination-target members 3, 103. L=0 (mm) in the horizontal axis corresponds to one end positioned on the side of light-emitting devices 10, 102 of illumination-target members 3, 103. L=500 (mm) in the horizontal axis corresponds to the other end of illumination-target members 3, 103. In FIG. 7, the vertical axis represents an illumination (1×) on external surfaces 3*b*, 103*b* of illumination-target members 3, 103. The surface shape of light flux controlling member 11 is designed by assuming point light emission in emission center 10*a* of light-emitting device 10. On the other hand, the simulation experiment regarding FIG. 7 is conducted by focusing on an emitting light flux from the entire output surface of light-emitting device 10

As shown by illuminance indication line D in FIG. 7, lighting device 101 in Conventional Example 1 for illuminating illumination-target member 103 by light-emitting device 102 only has the maximum illumination near one end (L=about 20 to 25 (mm)) of illumination-target member 103, generating a specific bright section near one end (near light-emitting device 102) of illumination-target member 103. As the distance from the maximum illumination position (L=about 20 to 25 (mm)) increases, the illumination falls rapidly in lighting device 101 in Conventional Example 1, the illumination falls about 1/100 of the maximum illumination (about 8000 (1×)) in the position of L=200 (mm), the illumination further falls gradually in the range of L=200 (mm) to 350 (mm), and the illumination becomes a very small value (0 to about 30 (1×)) in the position beyond L=350 (mm)

In contrast, lighting device 1 using light flux controlling member 11 according to the present embodiment maintains the illumination of about 600 to 1000 (1×) in the range of L=25 (mm) to 250 (mm) as shown by illuminance indication line A in FIG. 7 and the illumination gradually decreases in the range of L=250 (mm) to 500 (mm). Lighting device 1 using light flux controlling member 11 according to the present embodiment keeps the illumination at the other end (L=500 (mm)) of illumination-target member 3 at a value almost the same as the illumination in the position of L=about 200 (mm) in Conventional Example 1 (see illuminance indication lines A, D in FIG. 7)

Thus, compared with Conventional Example 1, lighting device 1 using light flux controlling member 11 according to the present embodiment can uniformly illuminate entire illumination-target member 3 without generating a specific bright section near light-emitting device 10 (see illuminance indication lines A, D in FIG. 7)

(Effect of the Present Embodiment)

As described above, compared with lighting device 101 according to Conventional Example 1, lighting device 1 using light flux controlling member 11 according to the present embodiment can illuminate the pair of illumination-target members 3, 3 arranged approximately in parallel with optical axis L1 of light-emitting device 10. That is, compared with a case when illumination-target member 3 is illuminated only by light-emitting device (10, 102) without using light flux controlling member 11 (compared with lighting device 101 according to Conventional Example 1), lighting device 1 according to the present embodiment can also illuminate illumination-target surfaces 3*a*, 3*a* near bottom plate 4 at a distant from light-emitting device 10 without generating a specific bright section near light-emitting device 10

In lighting device 1 according to the present embodiment, compared with light guide plate 114 constituting lighting device 111 according to Conventional Example 2, light flux controlling member 11 becomes extremely small and thus, the overall structure can be simplified and also the total weight can be reduced (Modification of the Lighting Device)

modification (lighting device 1A) of lighting device 1 shown in FIG. 4. Lighting device 1A according to the present modification has the same configuration as lighting device 1 in FIG. 4 excluding a portion on the side of bottom plate 4. Thus, lighting device 1A shown in FIG. 8 has the same reference numerals attached to the same sections as those of lighting device 1 in FIG. 4 and a description overlapping with the description of lighting device 1 in FIG. 4 is omitted Reflection member 25 is set up on the side of the inner surface (surface opposite to light-emitting device 2) of bottom plate 4 of lighting device 1A. Lighting device 1A reflects light directly reaching the side of bottom plate 4 of light emitted from light-emitting device 2 and light reaching the side of bottom plate 4 after being reflected by illumination-target members 3, 3 of light emitted from light-emitting device 2 by reflection member 25 and uses the light reflected by reflection member 25 as illuminating light of illumination-target members 3, 3. Reflection member 25 may be made of any material superior in light reflection to the material of case 8 and is formed of an aluminum plate, stainless plate, aluminum foil, aluminum evaporated layer, silver evaporated layer or the like. A material that appropriately scatters reflected light may be used for reflection member 25

Lighting device 1A as described above can reduce light losses and use light efficiently as illuminating light of illumination-target members 3, 3 and thus, compared with lighting device 1 shown in FIG. 4, can illuminate illumination-target members 3, 3 with higher illumination more uniformly (see illuminance indication line B in FIG. 7)

Figure 9A:
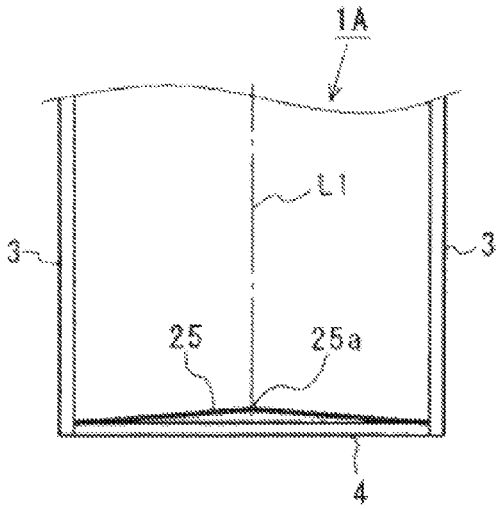
FIG. 9 is a diagram showing a modification of a reflection member used in the lighting device shown in FIG. 8.
Figure 9B:
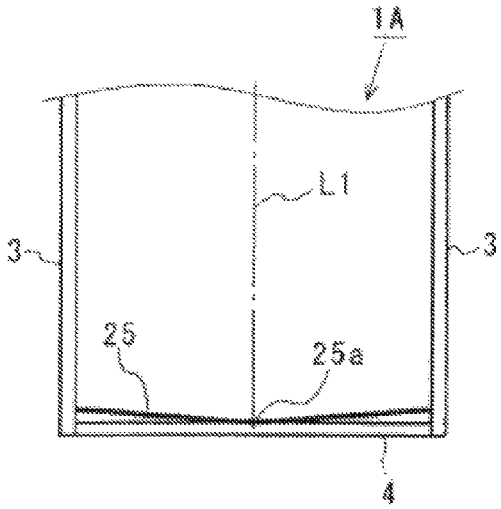
Figure 9C:
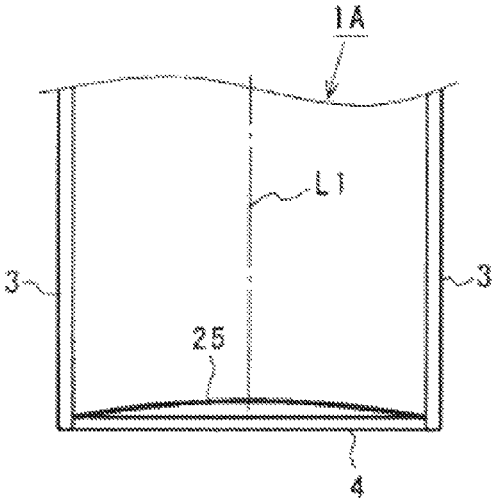
Figure 9D:
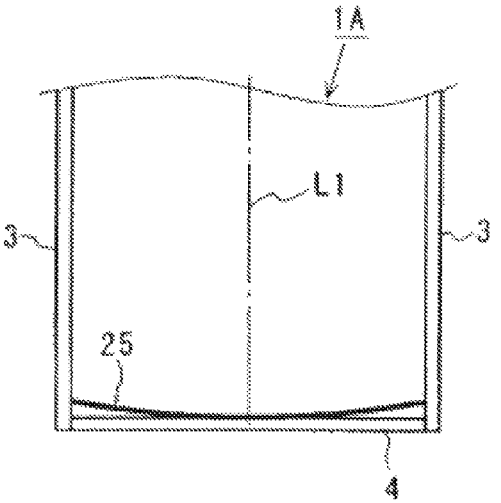

As shown in FIG. 9A or 9B, reflection member 25 may be formed by folding so that apex 25*a* is positioned on optical axis 1 and the section is substantially triangular to reflect light toward illumination-target member 3. As shown in FIG. 9C or 9D, reflection member 25 may be formed as a convex curbed surface or concave curbed surface to efficiently illuminate illumination-target members 3, 3 with reflected light (Embodiment 2)

Figure 10A:
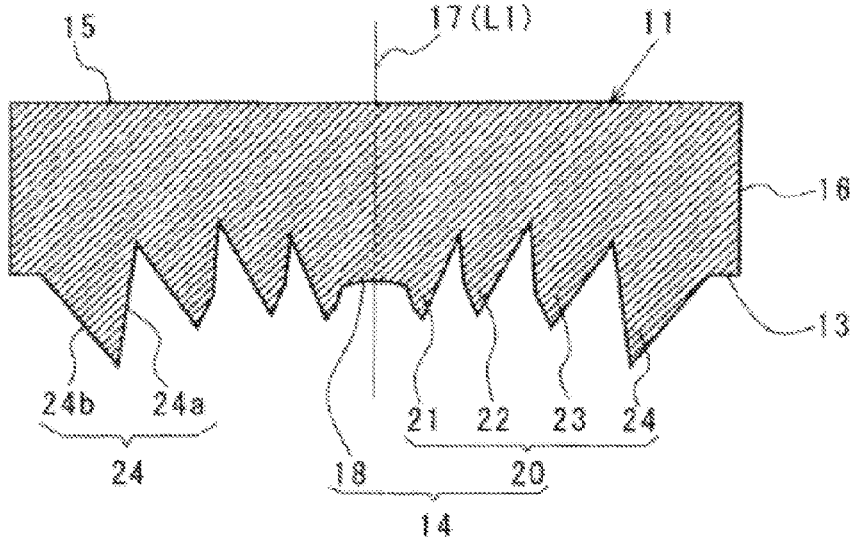
FIG. 10 is a diagram showing the light flux controlling member according to Embodiment 2 of the present invention.
Figure 10B:
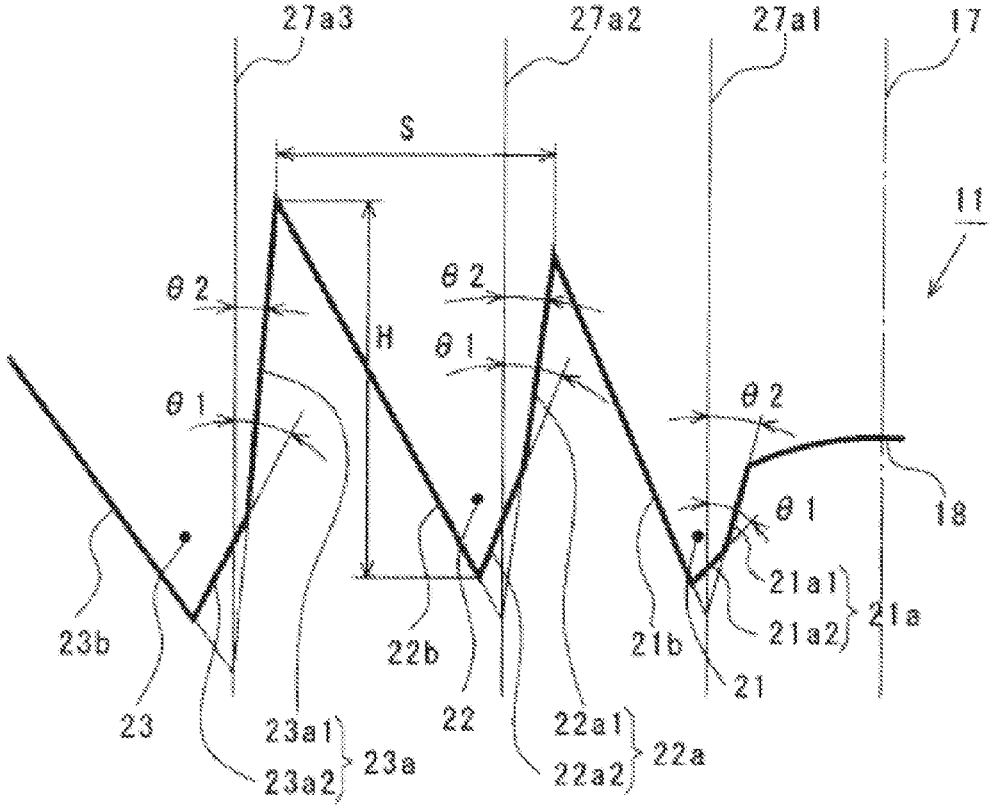

FIG. 10 shows Embodiment 2 of light flux controlling member 11. Light flux controlling member 11 shown in FIG. 10 has the same configuration as light flux controlling member 11 in Embodiment 1 shown in FIG. 5 excluding second input surface 20 and thus, the same reference numerals are attached to the same structural elements as those in light flux controlling member 11 shown in FIG. 5 and a description overlapping with the description of light flux controlling member 11 in Embodiment 1 is omitted. Incidentally, FIG. 10A is a diagram corresponding to FIG. 5B. FIG. 10B is an enlarged view of a portion (a portion of on the side of second input surface 20) of FIG. 10A As shown in FIG. 10, light flux controlling member 11 in the present embodiment tilts first inclined surfaces 21*a* to 23*a* of three prism projections 21 to 23 in two stages. That is, first to third prism projections 21 to 23 divide first inclined surfaces 21*a* to 23*a* into root inclined surface portions 21*a*1 to 23*a*1 positioned on the root side of prism projections 21 to 23 and tip inclined surface portions 21*a*2 to 23*a*2 positioned on the tip side of prism projections 21 to 23

It is assumed here that light flux controlling member 11 is cut by a virtual plane including center axis 17 and perpendicular to output surface 15 (virtual plane along center axis 17) (cross sectional views of FIGS. 10A and 10B). In this case, first inclined surfaces 21*a* to 23*a* of first to third prism projections 21 to 23 are formed in such a way that inclination angle θ1 of tip inclined surface portions 21*a*2 to 23*a*2 to virtual lines 27*a*1 to 27*a*3 parallel to center axis 17 is larger than inclination angle θ2 of root inclined surface portions 21*a*1 to 23*a*1 to virtual lines 27*a*1 to 27*a*3 parallel to center axis 17 (θ1>θ2). That is, first to third prism projections 21 to 23 are formed in such a way that the inclination (projection point angle) of tip inclined surface portions 21*a*2 to 23*a*2 to second inclined surfaces 21*b* to 23*b* is larger than the inclination of root inclined surface portions 21*a*1 to 23*a*1 to second inclined surface 21*b* to 23*b*

Figure 11:
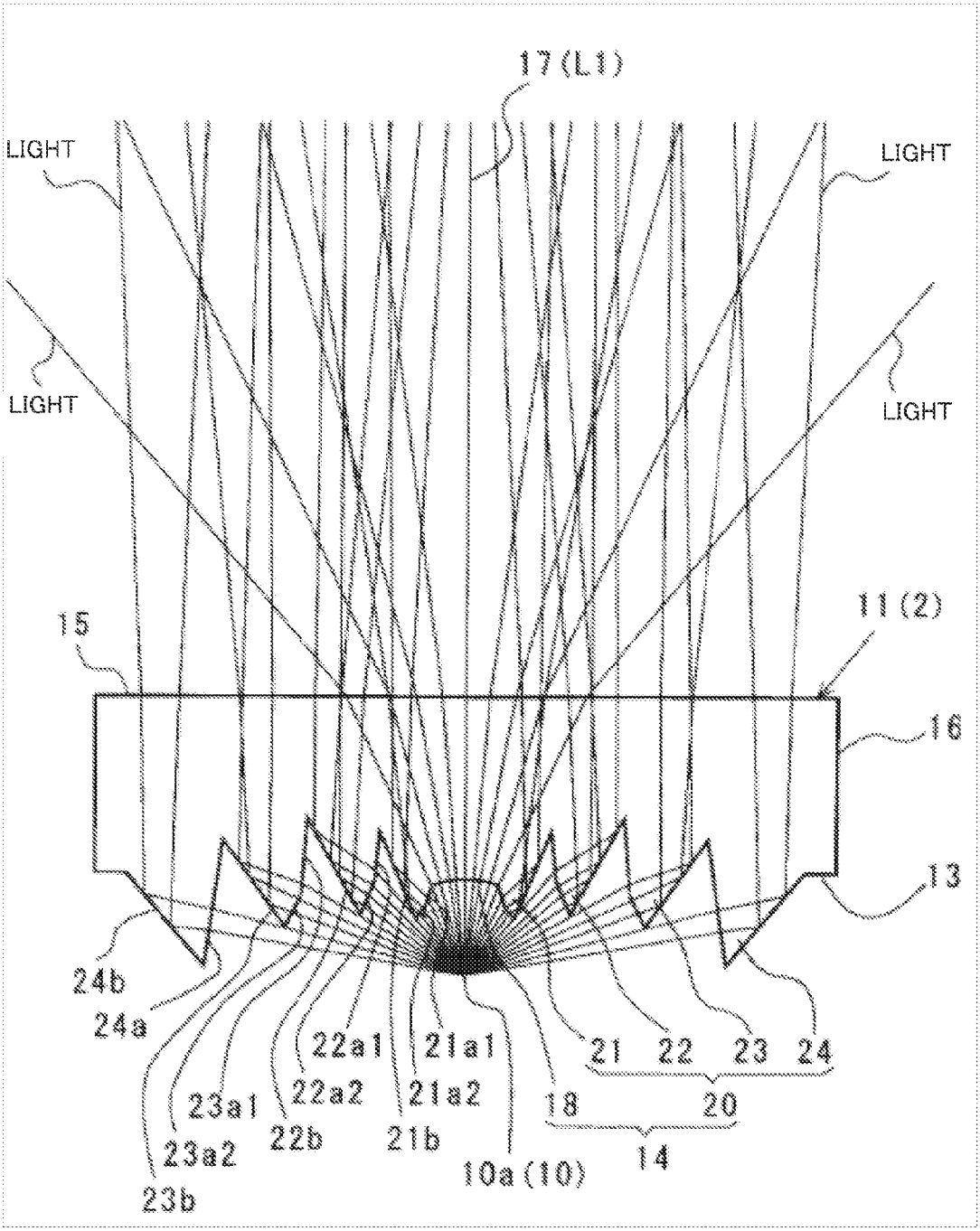
FIG. 11 is a diagram illustrating the function of the light flux controlling member according to Embodiment 2 of the present invention.

First to third prism projections 21 to 23 formed in this manner totally reflect, as shown in FIG. 11, light reaching second inclined surfaces 21*b* to 23*b* by entering from tip inclined surface portions 21*a*2 to 23*a*2 of first inclined surfaces 21*a* to 23*a* toward the side of output surface 15 by second inclined surfaces 21*b* to 23*b*. First to third prism projections 21 to 23 also totally reflect light reaching second inclined surfaces 21*b* to 23*b* by entering from root inclined surface portions 21*a*1 to 23*a*1 of first inclined surfaces 21*a* to 23*a* toward the side of output surface 15 by second inclined surfaces 21*b* to 23*b*. The light totally reflected by second inclined surfaces 21*b* to 23*b* is emitted out of light flux controlling member 11 from output surface 15 of light flux controlling member 11. Fourth prism projection 24 of light flux controlling member 11 totally reflects, as shown in FIG. 11, light reaching second inclined surface 24*b* by entering from first inclined surface 24*a* toward the side of output surface 15 by second inclined surface 24*b*. The light totally reflected by second inclined surface 24*b* of fourth prism projection 24 is emitted out of light flux controlling member 11 from output surface 15 of light flux controlling member 11

Figure 12:
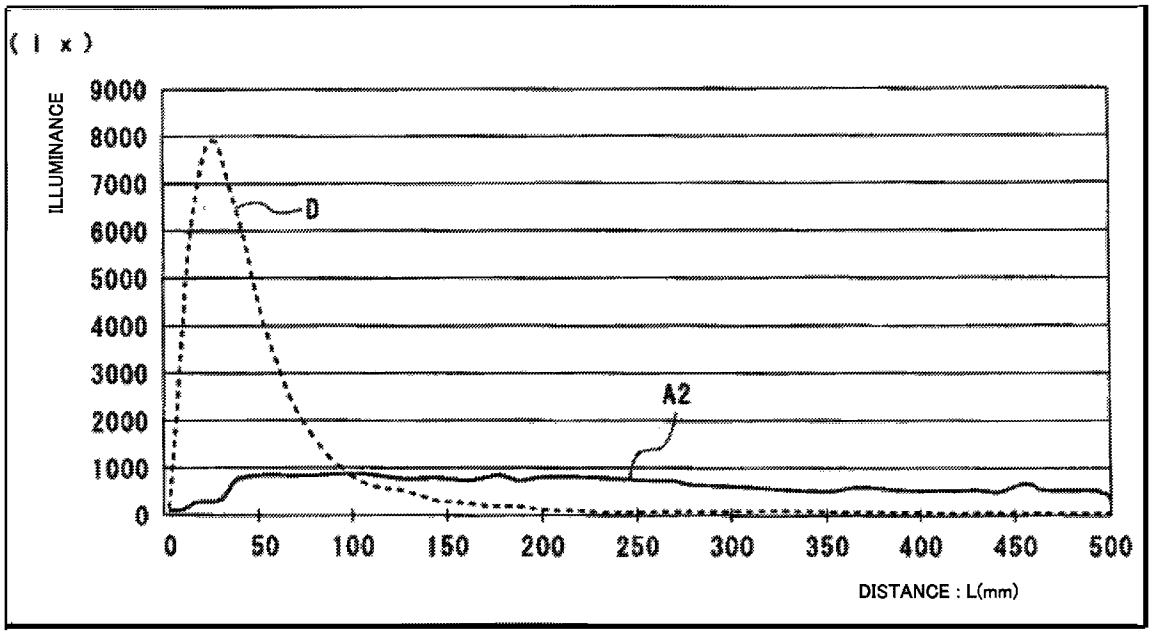
FIG. 12 is a diagram showing illuminations of illumination-target surfaces of illumination-target members in the lighting device using the light flux controlling member according to Embodiment 2 of the present invention and illuminations of illumination-target surfaces of illumination-target members in the lighting device according to Conventional Example 1 for comparison.

FIG. 12 is a diagram corresponding to FIG. 7 and shows an illumination of external surface 3*b* of illumination-target member 3 in lighting device 1 using light flux controlling member 11 according to the present embodiment (see FIG. 4 and illuminance indication line A2 in FIG. 12) and an illumination of external surface 103*b* of illumination-target member 103 in lighting device 101 according to Conventional Example 1 (see FIG. 14 and illuminance indication line D in FIG. 12) for comparison. As shown in FIG. 12, lighting device 1 using light flux controlling member 11 according to the present embodiment has enough illumination to be used for illumination on external surface 3*b* in positions from one end (L=0 (mm)) on the side of light-emitting device 10 of illumination-target member 3 to L≈40. The illumination on the external surface 3*b* is kept approximately constant in the range of L≈40 (mm) to L≈100 (mm) and gradually and smoothly decreases in the range of L≈100 (mm) to L=500 (mm). Moreover, as shown in FIG. 12, lighting device 1 using light flux controlling member 11 according to the present embodiment has, compared with lighting device 1 using light flux controlling member 11 according to Embodiment 1 (see FIG. 4 and illuminance indication line A in FIG. 7), a smooth and small illumination change in the center section (L=200 (mm) to 300 (mm)) of external surface 3*b* to which an observer pays attention. Also, as shown in FIG. 12, lighting device 1 using light flux controlling member 11 according to the present embodiment has, compared with lighting device 1 using light flux controlling member 11 according to Embodiment 1 (see FIG. 4 and illuminance indication line A in FIG. 7), a higher illumination on external surface 3*b* at the other end (L=500 (mm)) of illumination-target member 3 (high illumination about half the illumination on the external surface 3*b* in L≈40 (mm) to 100 (mm)) so that entire illumination-target surface 3*a* can be illuminated more uniformly As described above, light flux controlling member 11 according to the present embodiment divides first inclined surfaces 21*a* to 23*a* of first to third prism projections 21 to 23 into two groups of root inclined surface portions 21*a*1 to 23*a*1 and tip inclined surface portions 21*a*2 to 23*a*2 to make the light intensity distribution of emission light from output surface 15 different from that of emission light of light flux controlling member 11 according to Embodiment 1. Accordingly, compared with light flux controlling member 11 according to Embodiment 1, illumination-target surface 3*a* can be illuminated more uniformly (see FIG. 4)

Light flux controlling member 11 according to the present embodiment divides first inclined surfaces 21*a* to 23*a* of first to third prism projections 21 to 23, which are smaller than fourth prism projection 24, into two groups of root inclined surface portions 21*a*1 to 23*a*1 and tip inclined surface portions 21*a*2 to 23*a*2. Accordingly, the projection point angle can be made larger than the projection point angle of first to third prism projections 21 to 23 in light flux controlling member 11 according to Embodiment 1 (see FIGS. 5 and 10) and thus, an injection molding die can be filled with molten resin more reliably, improving molding precision. The shape of the second prism projection 22 in light flux controlling member 11 according to the present embodiment may be exemplified as follows: projection root width S: 1.47 mm, projection height H: 2.05 mm, projection point angle (angle formed by tip inclined surface portion 22*a*2 and second inclined surface 22*b*): 50.7°, angle formed by root inclined surface portion 22*a*1 and second inclined surface 22*b*: 36° (see FIG. 10B) That is, when tip inclined surface portion 22*a*2 is not formed on first inclined surface 22*a*, compared with a case when tip inclined surface portion 22*a*2 is formed on first inclined surface 22*a*, second prism projection 22 has the projection point angle of 36°, which is an acute angle, and the projection height H is as high as 2.1 mm, making variations in shape of the projection tip by injection molding more likely An aspect of light flux controlling member 11 of the present embodiment in which first inclined surfaces 21*a* to 23*a* of first to third prism projections 21 to 23 are divided into root inclined surface portions 21*a*1 to 23*a*1 and tip inclined surface portions 21*a*2 to 23*a*2 is illustrated, but the present invention is not limited to such an example and first inclined surfaces of one or two of all prism projections 21 to 24 may be divided into root inclined surface portions and tip inclined surface portions to make the light intensity distribution of emission light from output surface 15 different from that of emission light of light flux controlling member 11 according to Embodiment 1

In light flux controlling member 11 according to the present embodiment, in consideration of the light quantity distribution of an emitting light flux from light-emitting device 10, first inclined surfaces may be divided into two groups of root inclined surface portions and tip inclined surface portions regarding all prism projections positioned so that the angle formed by optical axis L1 (center axis 17) of light-emitting device 10 and the traveling direction of light emitted from emission center 10*a* of light-emitting device 10 is in the range of 0° to 80°

In light flux controlling member 11 according to the present embodiment, root inclined surface portions 21*a*1 to 24*a*1 and tip inclined surface portions 21*a*2 to 24*a*2 may be formed by dividing all first inclined surfaces 21*a* to 24*a* of first to fourth prism projections 21 to 24 into two groups Light flux controlling member 11 according to the present embodiment is not limited to dimensions and angles related to prism projection 22 exemplified in the present embodiment (Embodiment 3)

FIG. 13 is a diagram showing light flux controlling member 11 according to Embodiment 3 of the present invention.

Light flux controlling member 11 shown in FIG. 13 has the same configuration as light flux controlling member 11 in Embodiment 1 shown in FIG. 5 excluding first input surface 30. In FIG. 13, the same reference numerals are attached to the same structural elements as those in FIG. 5. Also, a description overlapping with the description of light flux controlling member 11 in Embodiment 1 is omitted That is, light flux controlling member 11 in the present embodiment has a convex curved shape (a curved shape or aspherical shape cut off as a portion of a sphere) protruding toward the side of light-emitting device 10 of first input surface 30 input surface 30 of light flux controlling member 11 according to the present embodiment causes light in the center section of a light flux of an emitting light flux from light-emitting device 10 to enter after being refracted into a direction closer to optical axis L1 (see FIG. 14)

Figure 14:
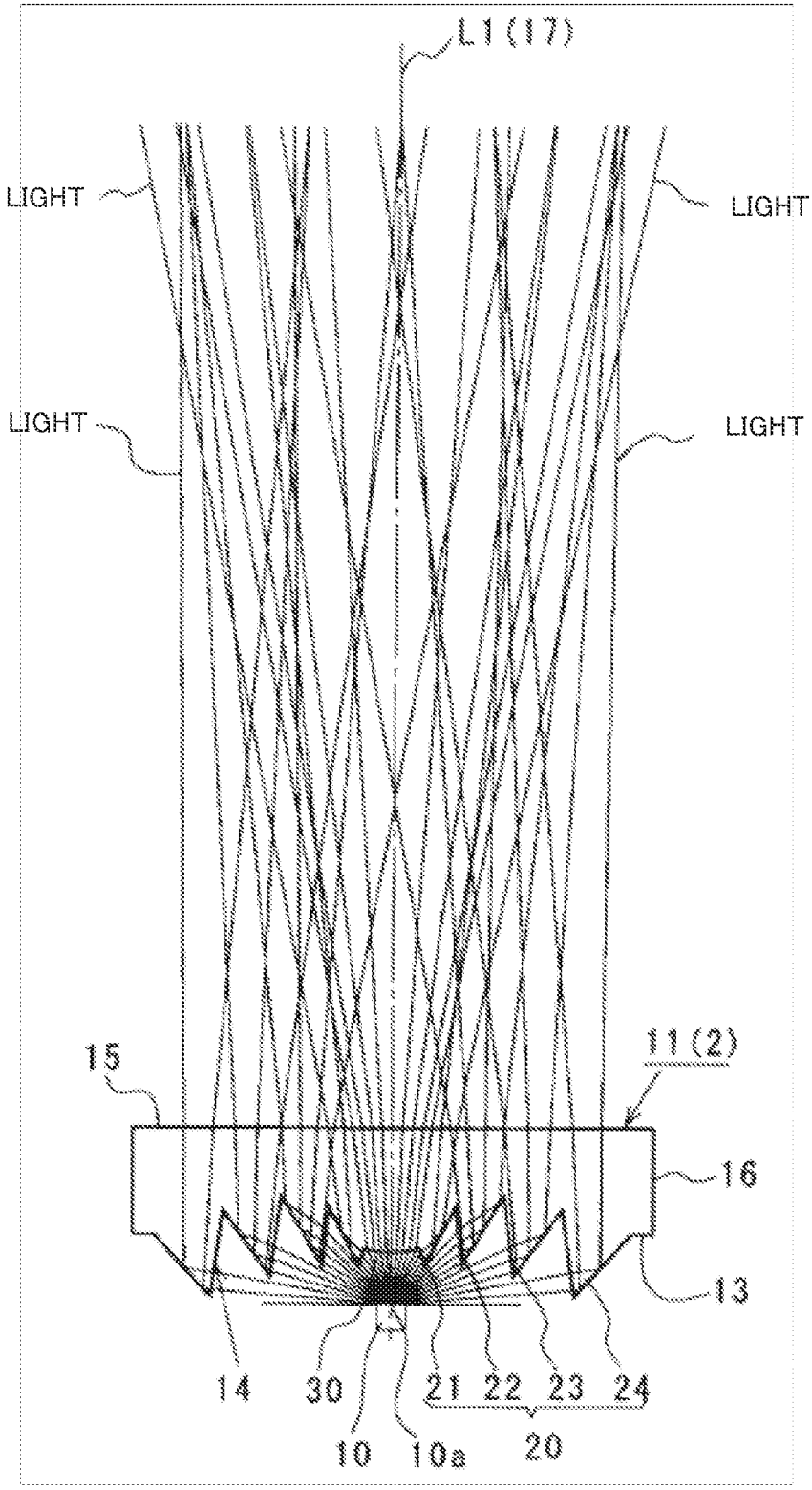
FIG. 14 is a diagram illustrating the function of the light flux controlling member according to Embodiment 3 of the present invention.

Second input surface 20 of light flux controlling member 11 according to the present embodiment is formed in such a way that light other than the center section of a light flux of an emitting light flux from light-emitting device 10 is brought closer to optical axis L1 (see FIG. 14)

Output surface 15 of light flux controlling member 11 according to the present embodiment is configured to control light from light-emitting device 10 entered from first input surface 30 or second input surface 20 so that the light is brought closer to optical axis L1 before being emitted (see FIG. 14)

Thus, though light emitted from output surface 15 of light flux controlling member 11 according to the present embodiment after passing through first input surface 30 is emitted more broadly than after passing through second input surface 20, compared with light emitted from output surface 15 of light flux controlling member 11 according to Embodiment 1, light entering first input surface 30 is emitted closer to optical axis L1. Therefore, the quantity of light traveling toward the edge side (top plate 6 side) on which light-emitting device 10 of illumination-target members 3, 3 are disposed decreases (see FIGS. 6 and 14)

Figure 8:
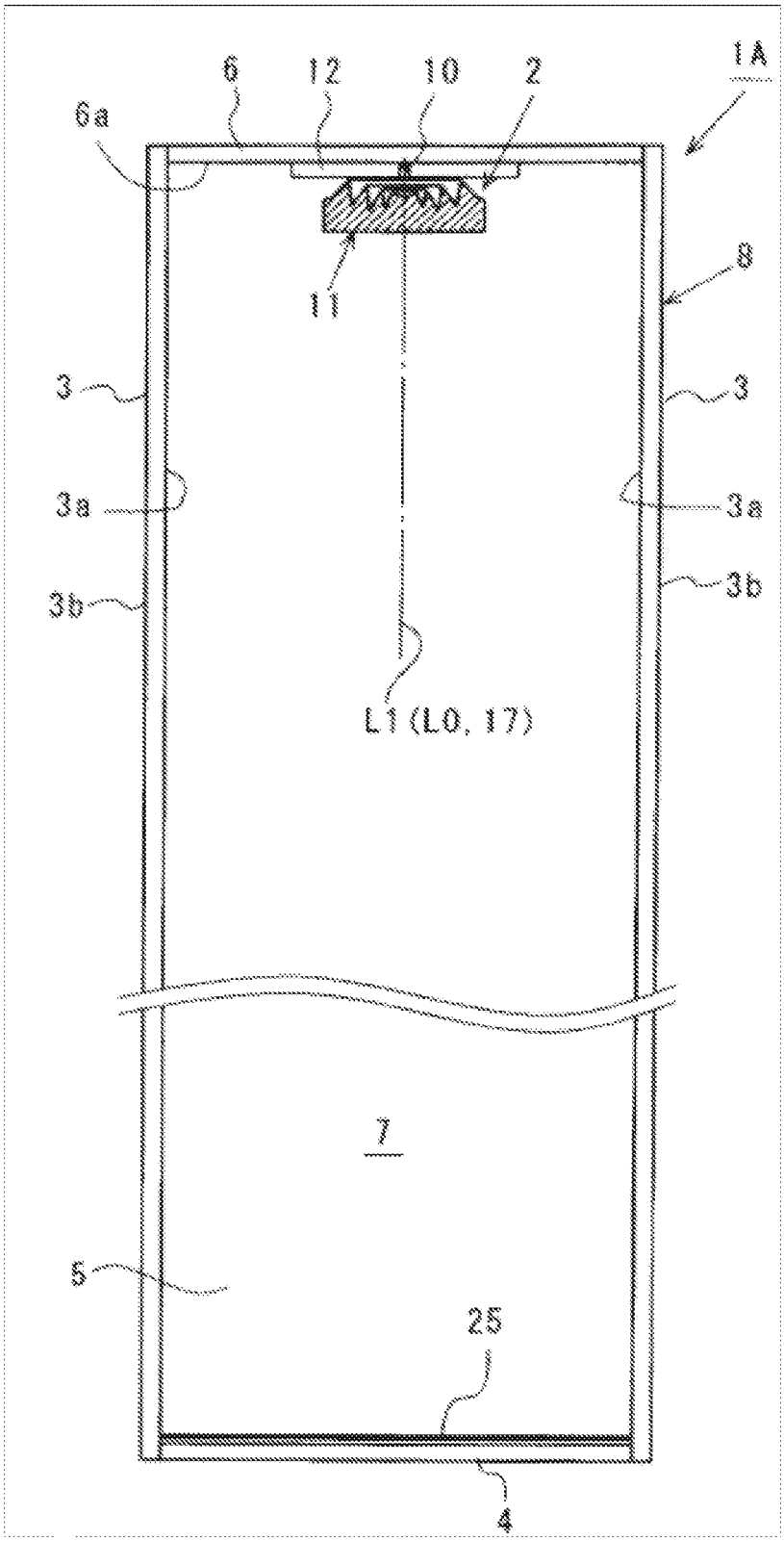
FIG. 8 is a diagram showing a modification of the lighting device in FIG. 4.

If light flux controlling member 11 according to the present embodiment is used for lighting device 1A in FIG. 8, the illumination is lower than the illumination (see illuminance indication line B in FIG. 7) of lighting device 1A using light flux controlling member 11 according to Embodiment 1 in the range of L=0 (mm) to 75 (mm) so that it is difficult to illuminate a wide range of illumination-target members 3, 3 (see illuminance indication line C in FIG. 7). That is, the range of illumination-target members 3, 3 in which lighting device 1A using light flux controlling member 11 according to the present embodiment can illuminate approximately uniformly, compared with lighting device 1A using light flux controlling member 11 according to Embodiment 1, starts with a position about L=75 (mm) extra apart. However, if a portion of L=0 (mm) to 75 (mm) close to light-emitting device 10 is covered by a frame section, illumination as a uniform illumination-target surface can be realized (see illuminance indication lines B and C in FIG. 7)

To obtain a narrow-framed uniform illumination-target surface from lighting devices 1, 1A in the present invention, it is advantageous to adopt a first input surface having negative power (for example, a concave lens surface) as first input surface 18 of light flux controlling member 11

(Other Modifications)

Lighting devices 1, 1A according to the present invention are not limited to the aspect in which light-emitting device 2 is arranged on top plate 6 (see FIGS. 4 and 8) and light-emitting device 2 may be arranged on bottom plate 4 or side plate 5. Lighting devices 1, 1A according to the present invention may have light-emitting device 2 arranged on a plurality or all of bottom plate 4, side plate 5, and top plate 6. Further, lighting devices 1, 1A according to the present invention may have light-emitting device 2 arranged in a corner section of illumination-target surface 3*a* if illumination-target surface 3*a* is square In accordance with the size of illumination-target surface 3*a*, lighting devices 1, 1A according to the present invention use one or a plurality of light-emitting devices 2

Lighting devices 1, 1A according to the present invention are not limited to the aspect in which top plate 6 is fixed to the ceiling for hanging and may be placed on the floor or fixed to the wall In lighting devices 1, 1A according to the present invention, one of the pair of illumination-target members 3, 3 may be formed of a material superior in light transmission so that illumination-target surface 3*a* of the other of the pair of illumination-target members 3, 3 is formed of a material of light reflection.

Industrial Applicability

A light-emitting device using a light flux controlling member according to the present invention can be applied as an lighting device that illuminates illumination-target members having light transmission such as advertising panels from the back side.

Reference Signs List

1, 1A Lighting device
2 Light-emitting device
3 Illumination-target member
3*a* Illumination-target surface
10 Light-emitting device (for example, an LED)
11 Light flux controlling member
14. Input surface
15 Output surface
18, 30 First input surface
20 Second input surface
21 to 24 Prism projection
21*a* to 24*a* First inclined surface
21*b* to 24*b* Second inclined surface
25 Reflection member
L1 Optical axis

The invention claimed is:

1. A light flux controlling member that is arranged on an edge side of illumination-target members together with a light-emitting device, emits light emitted from the light-emitting device from an output surface after causing the light to enter from an input surface, and illuminates illumination-target surfaces of the illumination-target members with the light emitted from the output surface, wherein the input surface includes a first input surface arranged so that the first input surface is positioned on an optical axis of the light-emitting device, which is approximately parallel to the illumination-target surfaces, and positioned opposite to the light-emitting device in a one-to-one correspondence and a second input surface positioned as if to enclose the first input surface, the first input surface is formed in such a way that the light in a center section of a light flux of emitted from the light-emitting device enter then is caused to travel toward the output surface, the second input surface is composed of a group of a plurality of ring-shaped prism projections formed concentrically around the optical axis as if to enclose the first input surface and is formed so that the light other than the light in the center section of the light flux is caused to enter, each of the prism projections include a first inclined surface that causes the light other than the light in the center section of the light flux to enter and a second inclined surface that totally reflects the light entered from the first inclined surface toward the output surface, and the input surface and the output surface are formed in such a way that the light emitted from the output surface via the first input surface with a maximum angle from the optical axis has a larger angle from the optical axis than the light emitted from the output surface via the second input surface with the maximum angle from the optical axis.

2. The light flux controlling member according to claim 1, wherein the first input surface is formed in a shape having negative power.

3. The light flux controlling member according to claim 1, wherein the first inclined surface of at least one prism projection of the group of prism projections is divided into root inclined surface portions positioned on a root side of the prism projection and tip inclined surface portions positioned on a tip side of the prism projection and is formed in such a way that, when the light flux controlling member is cut by a virtual plane including the optical axis and along the optical axis, an inclination of the tip inclined surface portions to the second inclined surface is larger than the inclination of the root inclined surface portions to the second inclined surface.

4. A light-emitting device, comprising a light-emitting device and the light flux controlling member according to claim 1.

5. An lighting device, comprising the light-emitting device according to claim 4 and a pair of illumination-target members arranged approximately in parallel with the optical axis of the light-emitting device constituting the light-emitting device, wherein illumination-target surfaces of the illumination-target members are illuminated with light emitted from the light-emitting device.

6. The lighting device according to claim 5, wherein the light-emitting device is arranged on one edge side of the pair of illumination-target members and a reflection member is arranged opposite to the light-emitting device on the other edge side of the pair of illumination-target members.

* * * * *